US006540651B1

(12) United States Patent
Aberton et al.

(10) Patent No.: US 6,540,651 B1
(45) Date of Patent: Apr. 1, 2003

(54) APPARATUS AND METHODS FOR EXERCISING BODY APPENDAGES

(75) Inventors: Mark J. Aberton, Sandy, UT (US); Cory W. Anderson, Kearns, UT (US); Michael H. Bourne, Salt Lake City, UT (US); E. Marc Mariani, Salt Lake City, UT (US)

(73) Assignee: Physician Therapy Supply, L.C., Salt Lake City, UT (US)

( * ) Notice: Subject to any disclaimer, the term of this patent is extended or adjusted under 35 U.S.C. 154(b) by 0 days.

(21) Appl. No.: 09/551,081

(22) Filed: Apr. 18, 2000

(51) Int. Cl.[7] ..... A63B 21/02; A63B 23/04

(52) U.S. Cl. ..... 482/124; 482/79; 482/125; 482/129; 482/904

(58) Field of Search ..... 482/10, 79, 44, 482/124, 129, 139, 904, 125; 602/36

(56) References Cited

U.S. PATENT DOCUMENTS

| | | | | |
|---|---|---|---|---|
| 3,659,846 A | | 5/1972 | Kanicki | |
| 4,026,549 A | | 5/1977 | Gunn | |
| 4,059,265 A | | 11/1977 | Wieder et al. | |
| 4,245,839 A | | 1/1981 | Trent | |
| 4,544,155 A | * | 10/1985 | Wallenbrock et al. | 482/129 |
| 4,596,387 A | * | 6/1986 | Roberts | 482/139 |
| 4,685,671 A | | 8/1987 | Hagerman et al. | |
| 4,948,117 A | | 8/1990 | Burke | |
| 5,100,129 A | | 3/1992 | Porter et al. | |
| 5,167,601 A | | 12/1992 | Frappier | |
| 5,186,698 A | | 2/1993 | Mason et al. | |
| 5,277,688 A | | 1/1994 | Whittington et al. | |
| 5,306,222 A | * | 4/1994 | Wilkinson | 482/121 |
| 5,318,494 A | | 6/1994 | Santighian | |
| 5,344,373 A | | 9/1994 | Greene | |
| 5,362,295 A | | 11/1994 | Nurge | |
| 5,395,296 A | * | 3/1995 | Webster et al. | 482/130 |
| 5,433,688 A | | 7/1995 | Davies | |
| 5,505,677 A | * | 4/1996 | Hinds | 482/10 |
| 5,582,579 A | | 12/1996 | Chism et al. | |
| 5,593,374 A | * | 1/1997 | Gvoich | 482/123 |
| 5,626,544 A | * | 5/1997 | Foresto | 482/124 |
| 5,813,955 A | * | 9/1998 | Gutkowski et al. | 482/121 |
| 6,036,625 A | | 3/2000 | Woodruff | |

* cited by examiner

*Primary Examiner*—Jerome W. Donnelly
*Assistant Examiner*—Victor Hwang
(74) *Attorney, Agent, or Firm*—Parsons Behle & Latimer; Vanessa B. Pierce; Everett D. Robinson

(57) ABSTRACT

An exercise apparatus for exercising a body part is disclosed as including an attachment structure and a resistance member. The attachment structure is adapted for placement on the body part that is to be exercised. The attachment structure includes a plurality of fasteners positioned at different locations on the attachment structure. The resistance member provides resistance for exercising the body part. The resistance member has a first end and a second end. A resistance member fastener is located proximate the first end of the resistance member and is capable of fastening to at least one of the fasteners located on the attachment structure. The resistance member includes an anchor for removably attaching the second end of the resistance member to an anchor point. An apparatus for exercising a body part may also include a plurality of distinct identifications on the attachment structure for the plurality of fasteners.

4 Claims, 5 Drawing Sheets

APPARATUS AND METHODS FOR EXERCISING BODY APPENDAGES

BACKGROUND

1. The Field of the Invention

The present invention relates generally to equipment for physical therapy, rehabilitation and exercise, and more specifically to novel apparatus and methods for use by a person to exercise specific muscle groups and/or associated tendons and ligaments.

2. Background

Treatment and recovery from accidents or injuries often requires strengthening particular muscles and connective tissues through exercise. Many specialized exercises have been developed to strengthen particular muscles and connective tissues. Some of these exercises require a physical therapist or other person present to assist during the exercise. In addition, some exercises require a particular exercise machine or device which is typically only found or available at physical therapy clinics. A need therefore exists for an appropriate exercise device for use by the patient in his home, outside the clinical setting, unaided by another person.

Rehabilitation of particular skeletal or soft tissue injuries is facilitated by a structured and supervised strengthening, stretching, and range of motion exercise program. Rehabilitation is most effective when the exercise program can be periodically performed by the patient on a frequent basis. Patient participation in the exercise program is usually increased if the patient can perform the exercises within the framework of his or her daily activities without the necessity of traveling to a special facility for ongoing supervision or specialized equipment. Thus, exercise programs are desirable which can be performed in the home or the workplace with safe, simple, and inexpensive equipment once the supervising physician or therapist has adequately structured and demonstrated the exercise program to the patient.

Exercise or physical therapy equipment for personal use can be large and very expensive. This type of equipment, usually for strengthening exercises, may require a significant amount of floor space and storage space. Moreover, it is not always portable. Other types of equipment, such as gentle strengthening or stretching equipment, are designed to be compact, portable and inexpensive. However, this type of equipment typically utilizes uncomfortable hard plastic handles and cords which may pinch the body or cause bruises by diminishing blood circulation. An inexpensive, portable, comfortable exercise device is needed.

There are numerous existing exercise and/or rehabilitative devices and systems known in the prior art. In particular, it is common for exercise and/or rehabilitative systems to use elastic resistance to apply force to target muscle groups.

Additionally, many elastically resistant exercise and/or rehabilitative systems utilize fixed points of attachment to the patient's body. Still other elastically resistant exercise and/or rehabilitative systems are crudely adaptable such that they can be attached to more than one part of the patient's body.

Moreover, these systems range from mechanical fixed position equipment to lightweight portable devices. The more complex fixed mechanical devices generally satisfy the full clinical exercise requirements, but seldom satisfy the need for inexpensive, lightweight systems that can be used by an unaided patient. Conversely, the current available inexpensive and lightweight systems designed for use by the unaided patient are not capable of providing the full range of clinical exercise requirements.

Many systems have attempted to satisfy the need for systems that an unaided patient can use and that can be attached to various points on the patient's body in order to exercise various target muscle groups and provide the full range of clinical exercise requirements. One such system is U.S. Pat. No. 3,659,846, issued May 2, 1972 to Walter J. Kanicki. Therein is disclosed a device containing two straps that anchor around the desired part of the patient's body and a third strap positioned between the two anchoring straps, that attaches to an elastic member which is in turn anchored to a fixed object. The third strap is also attached to a pad which is designed to protect the patient's body from the forces exerted by the elastic. There are some disadvantages to this type of a system. For example, to transfer the device to another part of the same appendage, the patient must release the two attaching straps, reposition and reattach the device in the desired location. In order to transfer the device to another part of the body not on the same appendage, the patient must release the two anchoring straps and then step out of the third strap which is attached to the elastic, and repeat this procedure in reverse on the desired body part. Additionally, this device is incapable of attaching to various critical portions of the patient's body.

Additionally, since this device utilizes a single strand of elastic material, it allows for torsional concentric force application during exercise, thus creating the potential that the patient's body part will rotate and defeat the hoped for advantage of the exercise. Further, because of the limited attachment points to the patient's body, there is an inadequate loading point displacement when force is applied during exercise. Moreover, because of the limited attachment points there is a greater risk of abrasion and discomfort during exercise.

A shortcoming from a clinical perspective is that, because of the inexact attaching procedure, it is not possible for the patient, exercising by himself or herself, to target the exact and necessary muscles for an adequate rehabilitation and/or exercise program. Therefore, this system does not appear to provide the full range of necessary clinical exercises.

Another relevant reference is U.S. Pat. No. 5,100,129, issued on Mar. 31, 1992 to E. Illene Porter and Stephen R. Spencer. Therein is disclosed an elastically resistant exercising device that attaches through a series of straps directly and solely to the patient's foot for the purpose of exercising and strengthening the forward lower leg musculature. The elastic portion of this device consists of a single elastic tube attached to the bottom and anterior portion of the foot allowing the patient to apply force as the foot is rotated upward in the vertical plane.

This device appears to be adequate for its intended use, but it may be limited in its scope and application. It can only be attached to the patient's foot and its only practical application is in exercising and strengthening the forward musculature of the lower leg. Additionally, the fact that this device utilizes a single elastic tube allows the foot to rotate out of alignment during the exercise making the exercise and strengthening of specific muscles difficult.

Other references that employ elastically resistant systems are U.S. Pat. No. 5,277,683, issued on Jan. 11, 1994 to Chester Wilkins; U.S. Pat. No. 5,318,494, issued on Jun. 7, 1994 to Krikor Santighian; U.S. Pat. No. 5,344,373, issued on Sep. 6, 1994 to Allison K. Green; U.S. Pat. No. 5,186, 698, issued on Feb. 16, 1993 to Bradley R. Mason and Jeffrey T. Mason; U.S. Pat. No. 5,167,601, issued on Dec. 1, 1992 to John F. Frappier and assigned to Red River Valley Sports Medicine Institute, all of which are incorporated herein by reference.

The foregoing prior art does not appear to provide an inexpensive, lightweight system that can be used by an unaided patient that also provides for the full range of clinical exercise requirements. In addition, the prior art does not appear to utilize a system that allows the patient to anchor the exercising system to a scientifically predetermined anatomical position in order to specifically isolate and exercise both general and specific muscle groups for prophylactic or rehabilitative purposes. Moreover, it appears that the prior art does not allow a patient to follow a precise sequence of exercises prescribed by a physician or physical therapist by attaching the exercise system to specific sites on the patient's body in order to best serve the patient's particular prophylactic or rehabilitative needs.

Additionally, the prior art does not appear to utilize a form-fitting elastic cotton stocking, sleeve or head band that provides better resistance to loading point displacement and less abrasive action at the point of resistance loading.

Therefore, there remains a distinct need in the prior art for an inexpensive, lightweight system that can be used by an unaided patient that also provides for the full range of clinical exercise requirements. Additionally, there remains a distinct need in the prior art for a system that allows the patient to anchor the exercising system to a scientifically predetermined anatomical position in order to specifically isolate and exercise both general and specific muscle groups for prophylactic or rehabilitative purposes. Moreover, there remains a distinct need in the prior art for a system that allows a patient to follow a precise sequence of exercises prescribed by a physician or physical therapist by attaching the exercise system to specific predetermined sites on the patient's body in order to best serve the patient's particular prophylactic or rehabilitative needs. Finally, there remains a distinct need in the prior art for a form fitting elastic cotton stocking, sleeve or head band that provides better resistance to loading point displacement and less abrasive action at the point of resistance loading.

BRIEF SUMMARY AND OBJECTS OF THE INVENTION

In view of the foregoing, it is an object of the present invention to provide novel apparatus and methods for use by a person to exercise specific muscle groups and/or associated tendons and ligaments.

It is another object of the present invention to provide an inexpensive, lightweight apparatus that can be used by an unaided patient that also provides for the full range of clinical exercise requirements.

Further, it is also an object to provide an apparatus that allows the patient to anchor the exercising system to a scientifically predetermined anatomical position in order to specifically isolate and exercise both general and specific muscle groups for prophylactic or rehabilitative purposes.

Another object of the present invention is to provide an apparatus that allows a patient to follow a precise sequence of exercises prescribed by a physician or physical therapist by attaching the exercise system to specific predetermined sites on the patient's body in order to best serve the patient's particular prophylactic or rehabilitative needs.

It is still yet a further object of the present invention to provide for a form-fitting elastic cotton stocking, sleeve or head band described as a body part encompassing envelope that provides better resistance to loading point displacement and less abrasive action at the point of resistance loading.

Consistent with the foregoing objects, and in accordance with the embodiments as embodied and broadly described herein, an exercise apparatus for exercising a body part is disclosed as including an attachment structure and a resistance member. The attachment structure is adapted for placement on the body part that is to be exercised. In addition, the attachment structure includes a number of fasteners positioned at different locations on the attachment structure. The resistance member provides resistance for exercising the body part. The resistance member has a first end and a second end. A resistance member fastener is located proximate the first end of the resistance member and is capable of fastening to at least one of the fasteners located on the attachment structure. Moreover, the resistance member includes an anchor for removably attaching the second end of the resistance member to an anchor point. An apparatus for exercising a body part may also include a plurality of identifications on the attachment structure for the plurality of fasteners.

A method practiced in accordance with embodiments herein may include the steps of obtaining an apparatus for exercising the body part, placing an attachment structure on the body part, attaching a first end of a resistance member to a specific fastener of the plurality of fasteners, wherein the specific fastener was chosen by a user based on a specific exercise purpose, attaching a second end of the resistance member to an anchor point, and repetitiously moving the body part such that the resistance member provides resistance to achieve the specific exercise purpose.

The presently preferred embodiment comprises a body part encompassing envelope, such as an elastic material stocking, sleeve or head band, each having a plurality of location designators. Each location designator comprises a number, or other similar identifier such as a letter, and the first half of a hook-and-fastener temporary securing system generally represented as a numbered fixator.

The presently preferred embodiment also includes a flexible, elastic, elongated member formed of rubber, surgical tubing or equivalent elastomeric material, with first and second ends, the first end including the second half of the hook-and-fastener temporary securing system. The second end of the elastic member is designed for secure attachment to the third component which is an anchor for temporarily affixing the apparatus in a predetermined position. More specifically, the anchor is described as a length of tubing, rubber banding, or other elastomeric material, that loops through a portion of the anchor. The anchor preferably includes a semi-flexible portion, which conveniently may be affixed in a secure position by wedging it between a door and a doorjamb.

In use, the patient engages the presently preferred embodiment as follows. First, the patient places either the stocking, sleeve or headband over the appropriate portion of his or her body. Second, the patient then places the anchoring component securely in a door-jamb, or equivalent anchor. Third, the patient attaches the hook and loop fixator such as the type marketed under the trademark VELCRO on the stocking, sleeve or headband in a position corresponding with the exercise to be performed. Finally the patient performs the exercise movement by repeatedly increasing and decreasing resistance against a body part and muscle group.

BRIEF DESCRIPTION OF THE DRAWINGS

The foregoing and other objects and features of the present embodiments will become more fully apparent from the following description and appended claims, taken in conjunction with the accompanying drawings. Understanding that these drawings depict only typical embodiments and are, therefore, not to be considered limiting of the invention's scope, the embodiments will be described with additional specificity and detail through use of the accompanying drawings in which:

DETAILED DESCRIPTION

Figure 1:
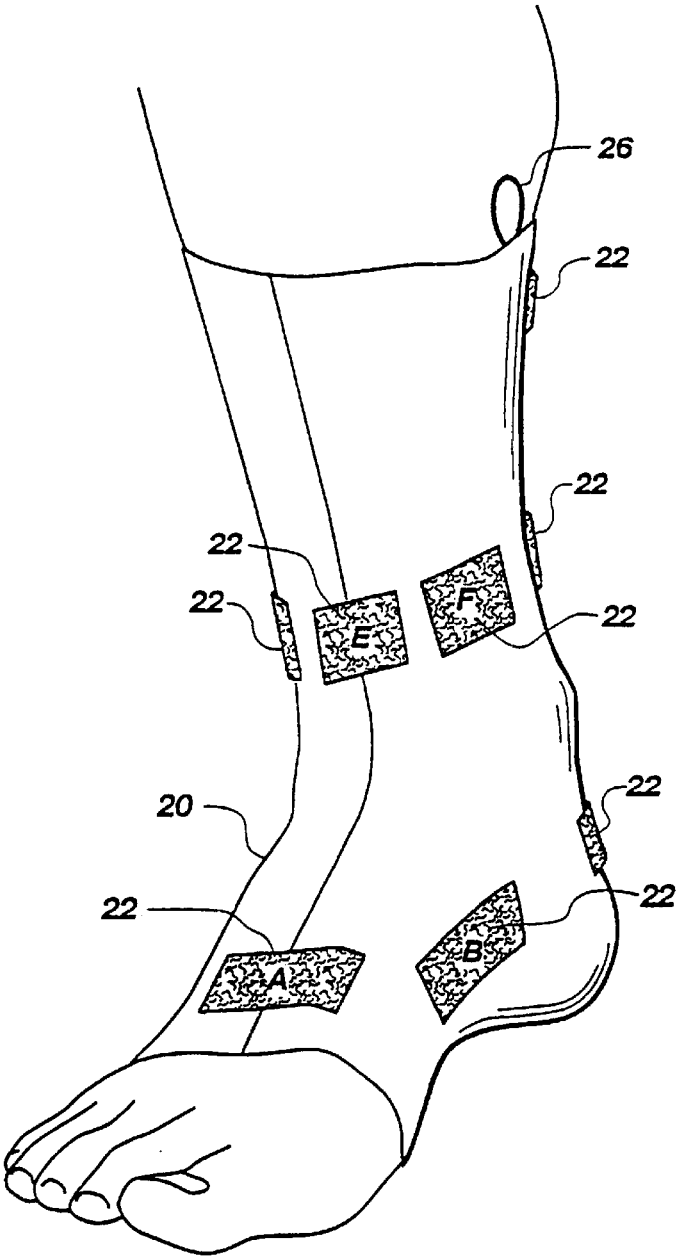
FIG. 1 is a perspective view of a present embodiment of a stocking including visible hook and loop fastener loading points or location designators.

It will be readily understood that the components of the embodiments, as generally described and illustrated in the Figures herein, could be arranged and designed in a wide variety of different configurations. Thus, the following more detailed description of the embodiments of the systems and methods disclosed, as represented in FIGS. 1 through 18, is not intended to limit the scope of the invention, as claimed, but is merely representative of the presently preferred embodiments.

The presently preferred embodiments will be best understood by reference to the drawings, wherein like parts are designated by like numerals throughout.

This invention relates generally to the field of physical therapy, rehabilitation and exercise equipment and more specifically to a novel apparatus and related method for unaided use by a patient to prophylactically or rehabilitatively exercise the major as well as specific muscle groups and associated tendons and ligaments of the neck, shoulder, arm, wrist, hip, knee and ankle by applying isometric and isotonic forces to those muscle groups.

An exercise apparatus for exercising a body part is disclosed as including an attachment structure and a resistance member. The attachment structure is adapted for placement on the body part that is to be exercised. In addition, the attachment structure includes a number of fasteners positioned at different locations on the attachment structure. The resistance member provides resistance for exercising the body part. The resistance member has a first end and a second end. A resistance member fastener is located proximate the first end of the resistance member and is capable of fastening to at least one of the fasteners located on the attachment structure. Moreover, the resistance member includes an anchor for removably attaching the second end of the resistance member to an anchor point.

The fasteners that are used may be any fasteners capable of removably fastening or removably attaching one item to another. Examples of fasteners that may be used include hook and loop fasteners, snaps, buttons, zippers and plastic clips.

An apparatus for exercising a body part may also include a plurality of identifications on the attachment structure for the plurality of fasteners.

The attachment structure is any structure capable of being placed on a body part of a user. For example, the attachment structure may be a sock-type envelope made for an ankle and a foot. In addition, it may be one or more bands made to be worn by a foot, an arm or a head. Moreover, it may be a sleeve-type envelope made specifically for an arm or wrist and forearm.

The resistance member provides resistance for the exercising that is accomplished. The resistance member may be a flexible elongated member. The resistance member may be made of rubber, surgical tubing, or the like. In addition, it may be a non-flexible member capable of providing resistance, such as, for example, a pulley system with weights and a cable.

The anchor may include a semi-flexible portion that is adapted to be wedged between a door and a doorjamb.

The exercise apparatus may be sold as a kit with instructions for use. The instructions for using the exercise apparatus kit may instruct a user how to perform specific exercises through use of the plurality of identifications of the attachment structure.

A method practiced in accordance with embodiments herein may include the steps of obtaining an apparatus for exercising the body part, placing an attachment structure on the body part, the attachment structure including a plurality of fasteners positioned at different locations on the attachment structure, attaching a first end of a resistance member to a specific fastener of the plurality of fasteners, wherein the specific fastener was chosen by a user based on a specific exercise purpose, attaching a second end of the resistance member to an anchor point, and repetitiously moving the body part such that the resistance member provides resistance to achieve the specific exercise purpose.

The presently preferred embodiments of the present invention comprise, first a body part encompassing envelope, such as an elastic material stocking, sleeve or head band, each having a plurality of location designators. Each location designator comprises a number, or other similar specifier or identifier such as a letter, and the first half of a hook-and-fastener temporary securing system generally represented as a numbered fixator.

A second component of the presently preferred embodiments includes a flexible, elastic, elongated member formed of rubber, surgical tubing or equivalent elastomeric material, with first and second ends, the first and including the second half of the hook-and-fastener temporary securing system. The second end of the elastic member is designed for secure attachment to the third component which is an anchor for temporarily affixing the apparatus in a predetermined position. More specifically, the anchor is described as a length of tubing, rubber banding, or other elastomeric material, that loops through a portion of the anchor. The anchor preferably includes a semi-flexible portion, which conveniently may be affixed in a secure position by wedging it between a door and a doorjamb.

In use, the patient engages the apparatus as follows. First, the patient places either the stocking, sleeve or headband over the appropriate portion of his or her body. Second, the patient then places the anchoring component securely in a doorjamb, or equivalent rigid fixed anchor. Third, the patient attaches the fixator on the stocking, sleeve or headband in a position corresponding with the exercise to be performed. Finally the patient performs the exercise movement by repeatedly increasing and decreasing resistance against a body part and muscle group.

Reference is now made to the drawings, wherein like numerals are used to denote like elements throughout. Referring to FIG. 1, the presently preferred embodiment for exercising the leg and/or foot comprises a stocking 20 or similar body part encompassing envelope which includes a plurality of hook and loop location designators 22. A unique letter or number A, B, C, etc. is assigned to each of the hook and loop location designators 22, and a loop 26 allowing the patient to grasp the stocking while pulling it on. The body encompassing envelope 20 is advantageously made from an elastic blend material. One skilled in the art will recognize that there are numerous materials and blends of materials that could be used in constructing the stocking, sleeve or headband and which fall within the scope of this invention.

Figure 2:
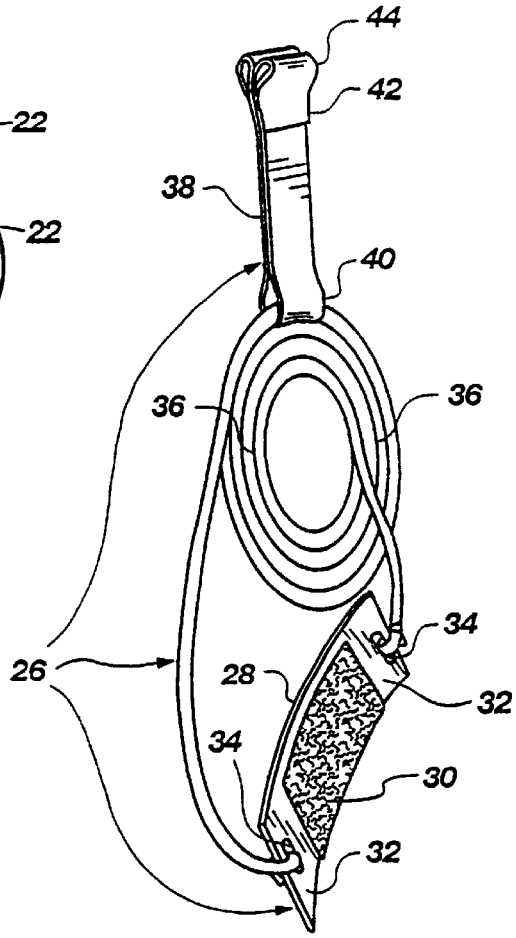
FIG. 2 is a perspective view of a present embodiment of a resistance component and anchoring component.

Referring now to FIG. 2, the presently preferred embodiment of the resistance member is a resistance component 26 which comprises a hook and loop fixator 28, a section of hook and loop material 30 in the center of the hook and loop fixator 28, a space without hook and loop material 32 on either side of the hook and loop fixator 28, two grommet eyelets 34 on opposite ends of the hook and loop fixator 28, and a length of elastomeric tubing 36 with each end of the tubing 36 anchored to the grommet eyelets 34 on the hook and loop fixator 28. In anchoring the tubing 36 to the eyelets 34, plastic cone stops (not shown) may be used. One skilled in the art will recognize that there are a variety of potential materials that could be used to make the hook and loop fixator 28, and that the elastomeric tubing 36 can be constructed from a variety of materials. Preferably the tubing is common surgical tubing. Additionally, one skilled in the art will recognize that the elastomeric tubing 36 can be constructed of a variety of gauges and lengths.

Continuing to refer to FIG. 2, the anchoring component, according to the present invention, comprises a length of one inch nylon webbing material 38, with one end attached to the elastomeric tubing 36 by means of a plastic loop connector 40, and with the other end rolled into a ball and sewn in place 42 to form a ball or knot 44 that anchors securely when wedged between a door and a doorjamb. One skilled in the art will recognize that the anchoring component 38 may be constructed from a variety of materials and attached to the elastomeric tubing 36 through a variety of means. One skilled in the art will also recognize that there are a variety of means by which the anchoring component 38 may be anchored in a doorjamb or to an equivalent rigid fixed anchor.

To use the presently preferred embodiments, the patient pulls on the stocking 20 using the loops 26, and makes certain that the hook and loop location designators 22 are positioned in the correct anatomical orientation. The patient would use the same procedure for putting on the sleeve or headband, which comprise alternative, but preferred embodiments of the present invention. The patient then secures the ball end 44 anchoring component into a doorjamb or other stationary object. The patient then places the hook and loop fixator 28 on the appropriate hook and loop location designator 22 so that the hook and loop components come into contact with each other. The patient chooses the particular hook and loop location designator 22 depending on the exercise the patient desires to perform. The patient then performs the desired exercise as shown, for illustrative purposes only, in FIGS. 3 through 14.

Figure 3:
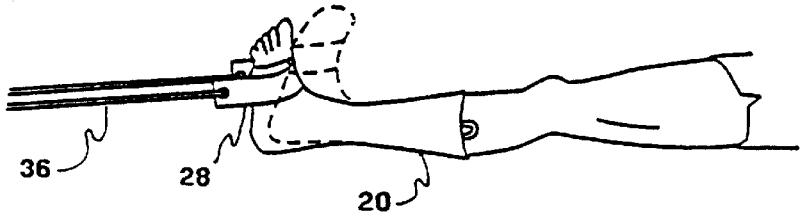
FIG. 3 is a side elevational view of the stocking and resistance components demonstrating dorsiflexion.

The following Figures are referred to for illustrative purposes only and should not be construed in any manner as a restriction on the current invention. Referring to FIG. 3, the hook and loop fixator is attached to the stocking 20 on the hook and loop position designator lettered A. The ankle is then flexed in a vertical plain in opposition to the resistance demonstrating dorsiflexion. This exercise strengthens, among other things, the tibialis anterior and extensor digitorum longus.

Figure 4:
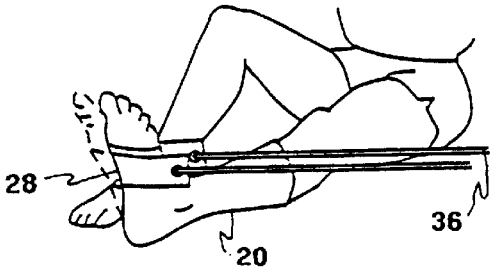
FIG. 4 is a perspective view of the stocking and resistance components demonstrating inversion.

Referring to FIG. 4, the stocking 20 and resistance component 26 are properly configured and secured. The ankle is then inverted in opposition to the resistance demonstrating inversion. This exercise strengthens, among other things, the tibialis posterior, flexor digitorum longus and flexor hallucis longus.

Figure 5:
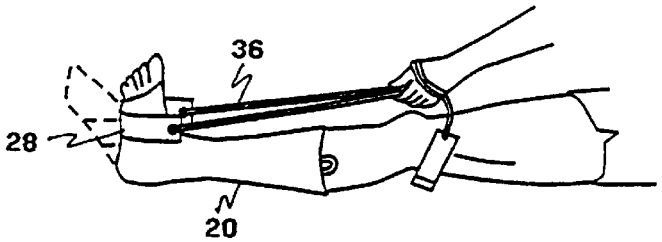
FIG. 5 is a side elevational view of the stocking and resistance components demonstrating plantar flexion.

Referring to FIG. 5, the stocking 20 and resistance component 26 are properly configured and secured. The ankle is then extended in opposition to the resistance demonstrating plantar flexion. This exercise strengthens, among other things, the gastrocnemius, soleus and plantaris.

Figure 6:
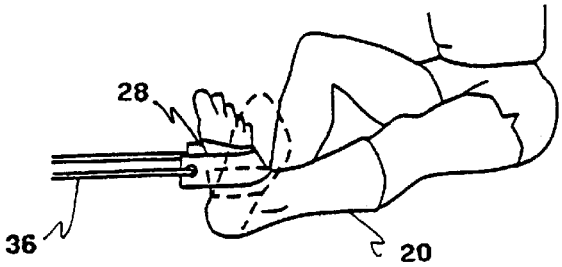
FIG. 6 is a perspective view of the stocking and resistance components demonstrating eversion.

Referring to FIG. 6, the stocking 20 and resistance component 26 are properly configured and secured. The ankle is then averted in opposition to the resistance demonstration eversion. This exercise strengthens, among other things, the peroneus longus, peroneus brevis and peroneus tertius.

Figure 7:
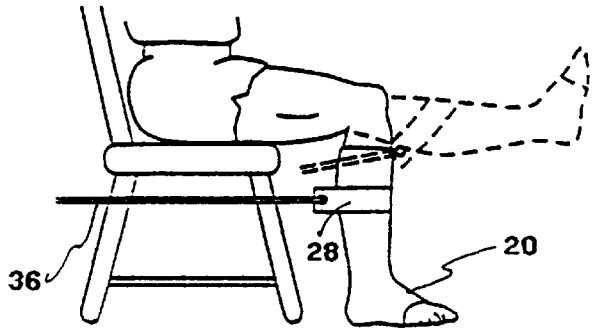
FIG. 7 is a side elevational view of the stocking and resistance components demonstrating knee extension.

Referring to FIG. 7, the stocking 20 and resistance component 26 are properly configured and secured. From a sitting position the knee is extended demonstrating knee extension. This exercise strengthens, among other things, the rectus femoris, vastus medialis, vastus intermedius and vastus lateralis.

Figure 8:
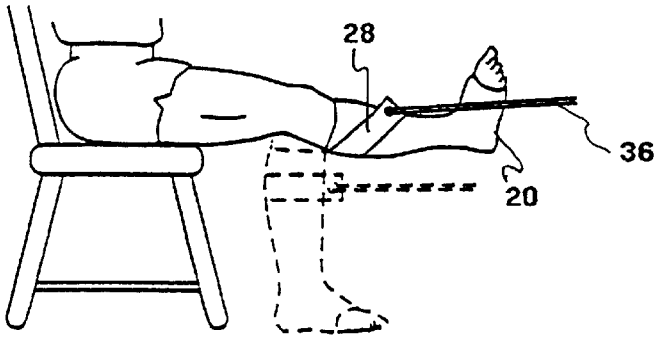
FIG. 8 is a side elevational view of the stocking and resistance components demonstrating knee flexion.

Referring to FIG. 8, the stocking 20 and resistance component 26 are properly configured and secured. From a sitting position the knee is flexed demonstrating knee flexion. This exercise strengthens, among other things, the biceps femoris, semimembranosus, semitendinosus, sartorius and gracilis.

Figure 9:
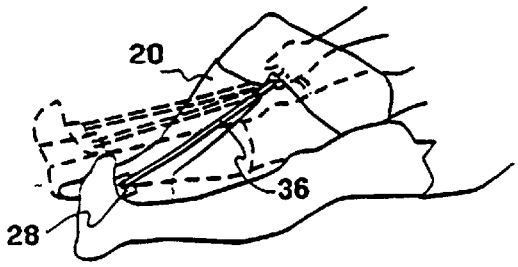
FIG. 9 is a perspective view of the stocking and resistance components demonstrating a knee press.

Referring to FIG. 9, the stocking 20 and resistance component 26 are properly configured and secured. From a sitting position the patient performs a knee press. This exercise strengthens, among other things, the gluteus maximus, rectus femoris, vastus medialis, vastus intermedius, vastus lateralis, biceps femoris, semimenbranosus, semitendinosus, sartorius and gracilis.

Figure 10:
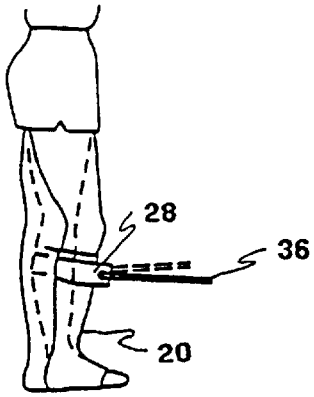
FIG. 10 is a side elevational view of the stocking and resistance components demonstrating terminal knee extension.

Referring to FIG. 10, the stocking 20 and resistance component 268 are properly configured and secured. From a standing position the knee is extended demonstrating terminal knee extension. This exercise strengthens, among other things, the gluteus maximum, rectus femoris, vastus medialis, vastus intermedius, vastus lateralis, biceps femoris, semimenbranosus, semitendinosus, sartorius and gracilis.

Figure 11:
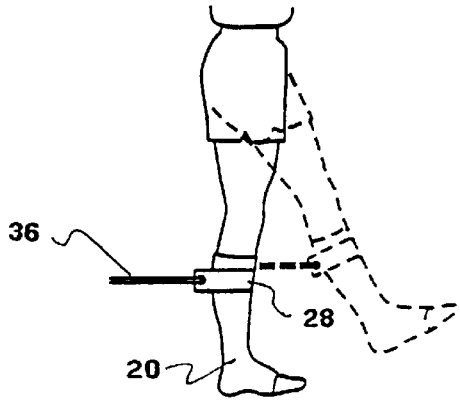
FIG. 11 is a side elevational view of the stocking and resistance components demonstrating hip flexion.

Referring to FIG. 11, the stocking 20 and resistance component 26 are properly configured and secured. From a standing position the hip is flexed demonstrating hip flexion. This exercise strengthens, among other things, the psoas and iliacus.

Figure 12:
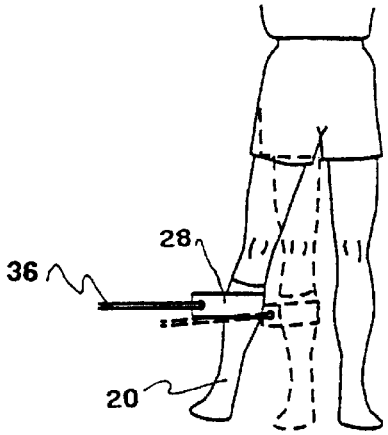
FIG. 12 is a front elevational view of the stocking and resistance components demonstrating hip adduction.

Referring to FIG. 12, the stocking 20 and resistance component 26 are properly configured and secured. From a standing position the hip is adducted demonstrating hip adduction. This exercise strengthens, among other things, the adductor magnus, adductor longus, adductor brevis, pectineus and gracilis.

Figure 13:
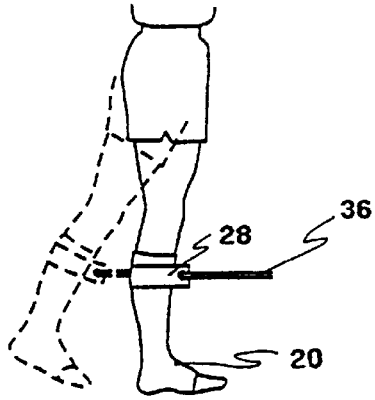
FIG. 13 is a side elevational view of the stocking and resistance components demonstrating hip extension.

Referring to FIG. 13, the stocking 20 and resistance component 26 are properly configured and secured. From a standing position the hip is extended demonstrating hip extension. This exercise strengthens, among other things, gluteus maximum, biceps femoris, semimembranosus, semitendinosus, sartorius and gracilis.

Figure 14:
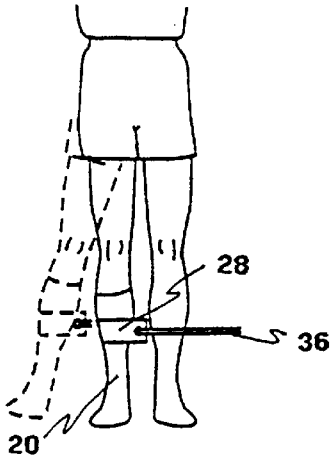
FIG. 14 is a front elevational view of the stocking and resistance components demonstrating hip abduction.

Referring to FIG. 14, the stocking 20 and resistance component 26 are properly configured and secured. From a standing position the hip is abducted demonstrating hip abduction. This exercise strengthens, among other things, gluteus maximus, gluteus minimus and tensor fasciae latae.

Figure 15:
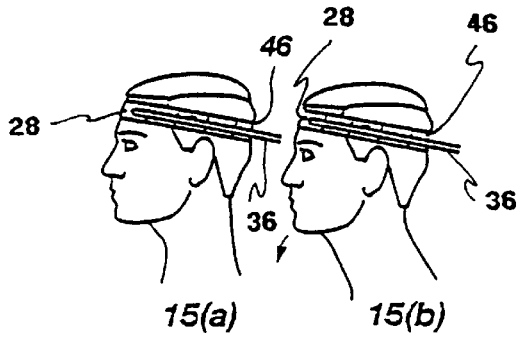
FIGS. 15(*a*) and 15(*b*) are side elevation views of the head band and resistant components demonstrating neck flexion.

Referring to FIG. 15, an alternative embodiment illustrates a head band 46 and resistance component 26 properly configured and secured. From a standing or sitting position the head is moved forward and down demonstrating flexion of the neck. This exercise strengthens, among other things, longus coli, scalenus anterior, scalenus medius and scalenus posterior.

Figure 16:
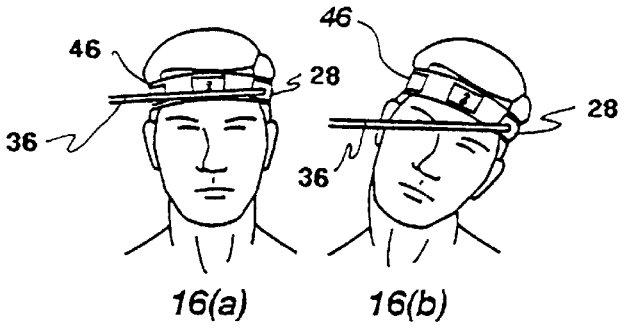
FIGS. 16(*a*) and 16(*b*) are front elevation views of the head band and resistant components demonstrating left sidebending.

Referring to FIG. 16, the head band 46 and resistance component 26 are properly configured and secured. From a standing or sitting position the head is moved from a vertical alignment to left tilt demonstrating side flexion of the neck. This exercise strengthens, among other things, levator scapulae, splenius cervicis, illiocostalis cervicis, longissimus cervicis, semispinalis cervicis, multifidus, intertransversarii, scaleni and sternocleidomastoid.

Figure 17:
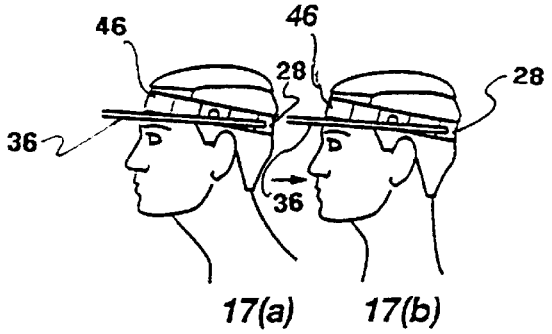
FIGS. 17(*a*) and 17(*b*) are side elevation views of the head band and resistant components demonstrating neck extension.

Referring to FIG. 17, the head band 46 and resistance component 26 are properly configured and secured. From a standing or sitting position the head is moved in a backward direction demonstrating extension of the neck. This exercise strengthens, among other things, splenius cervicis, semispinalis cervicis, longissimum cervicis and levator scapulae.

Figure 18:
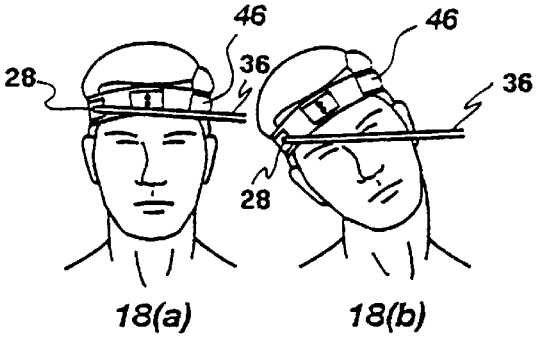
FIGS. 18(*a*) and 18(*b*) are front elevation views of the head band and resistant components demonstrating right sidebending.

Referring to FIG. 18, the head band 46 and resistance component 26 are properly configured and secured. From a standing or sitting position the head is moved from a vertical alignment to a right tilt demonstrating side flexion of the neck. This exercise strengthens, among other things, levator scapulae, splenius cervicis, illiocostalis cervicis, longissimus cervicis, semispinalis cervicis, multifidus, intertransversarii, sceleni and sternocleidomastoid.

In another preferred embodiment, not shown, the apparatus of the invention is similar in all respects to those described herein except that the body part encompassing envelope comprises an extended glove, or sleeve, rather than the indicated stocking or headband. As in the other embodiments, strategically placed location designators indicate exact position in which the velcro fixator should be placed.

From the above discussion, it will be appreciated that the present embodiments disclosed provide novel apparatus and methods for use by a person to exercise specific muscle groups and/or associated tendons and ligaments. The embodiments herein also provide an inexpensive, lightweight apparatus that can be used by an unaided patient that also provides for the full range of clinical exercise requirements.

It has also been shown that the present embodiments provide an apparatus that allows the patient to anchor the exercising system to a scientifically predetermined anatomical position in order to specifically isolate and exercise both general and specific muscle groups for prophylactic or rehabilitative purposes. Further, the patient may follow a precise sequence of exercises prescribed by a physician or physical therapist by attaching the exercise system to specific predetermined sites on the patient's body in order to best serve the patient's particular prophylactic or rehabilitative needs.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A portable, lightweight exercise apparatus comprising:

a stocking to be worn on a lower limb;

a plurality of location designators on said stocking arranged in at least two sets of plural location designators, one of said sets comprising an upper set of location designators adapted to be positioned above a wearer's ankle and another of said sets comprising a lower set of location designators adapted to be positioned below a wearer's ankle;

each of said location designators including a fastener and an identifier in denotive proximity to said fastener, each of the location designators alone or in combination corresponding to a particular lower limb exercise;

an elongated resistance member having a complimentary fastener selectively attachable to said fasteners; and an anchor releasably secured\ to said resistance member for selective engagement with a static structure.

2. The apparatus of claim 1, wherein said anchor is a wedge for engagement between a door and a doorjamb.

3. The apparatus of claim 1, further comprising instructions for using the apparatus, the instructions providing detailed information regarding the location designators and the particular lower limb exercises associated therewith.

4. A method of exercise comprising the steps of:

i) providing a stocking to be worn on a lower limb;

said stocking having a plurality of location designators arranged in at least two sets of plural location designators, one of said sets comprising an upper set of location designators and another of said sets comprising a lower set of location designators;

each of said location designators including a fastener and an identifier in denotive proximity to said fastener, each of the location designators alone or in combination corresponding to a particular lower limb exercise;

an elongated resistance member having a complimentary fastener selectively attachable to said fasteners;

an anchor releasably secured to said resistance member for selective engagement with a static structure;

ii) providing instructions having detailed information regarding the location designators and the particular lower limb exercises associated therewith;

iii) placing said stocking over a lower limb so that said upper set of location designators is positioned above the wearer's ankle and the lower set of location designators is positioned below the wearer's ankle;

iv) attaching said complementary fastener to at least one fastener corresponding with the particular lower limb exercise to be performed;

v) attaching said resistance member to said anchor; and vi) performing exercise movements corresponding to the particular lower limb exercise in accordance with said instructions for the particular lower limb exercise.

* * * * *